United States Patent [19]

Lam

[11] Patent Number: 4,826,428

[45] Date of Patent: May 2, 1989

[54] DECORATIVE CANDLE

[75] Inventor: Chun B. M. Lam, Aberdeen, Hong Kong

[73] Assignee: Ki Yip Chemical Works Limited, Hong Kong

[21] Appl. No.: 149,709

[22] Filed: Jan. 29, 1988

[30] Foreign Application Priority Data

Dec. 7, 1987 [GB] United Kingdom ..... 8728551

[51] Int. Cl.[4] ..... F23D 13/16

[52] U.S. Cl. ..... 431/291; 431/288; 431/289

[58] Field of Search ..... 431/291, 289, 288; 44/7.5; D26/9, 16; 422/12

[56] References Cited

U.S. PATENT DOCUMENTS

| | | | |
|---|---|---|---|
| 3,385,649 | 5/1968 | Hicks | 431/291 X |
| 3,744,956 | 7/1973 | Hess | 431/288 X |
| 4,427,366 | 1/1984 | Moore | 431/291 |
| 4,614,625 | 9/1986 | Wilson | 431/291 X |

*Primary Examiner*—Randall L. Green

*Attorney, Agent, or Firm*—Wood, Herron & Evans

[57] ABSTRACT

A candle arrangement has a body made up from a plurality of individual pieces of wax, a wick passing through this body, and containment means to keep the plurality of individual wax pieces together to form the candle body. Each of the plurality of wax pieces is shaped, such that a plurality of these wax pieces can be stacked together to form a decorative candle body.

6 Claims, 1 Drawing Sheet

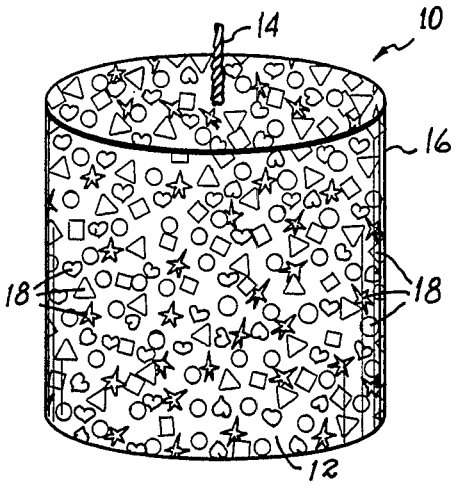
FIG. 1
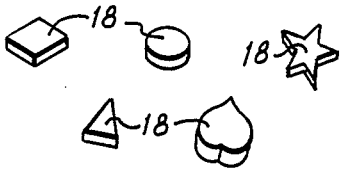
FIG. 3
FIG. 2
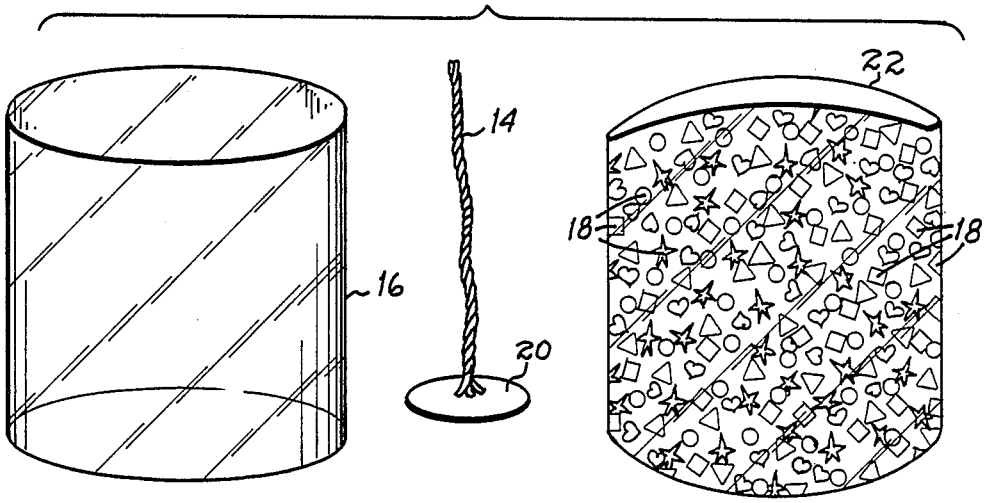
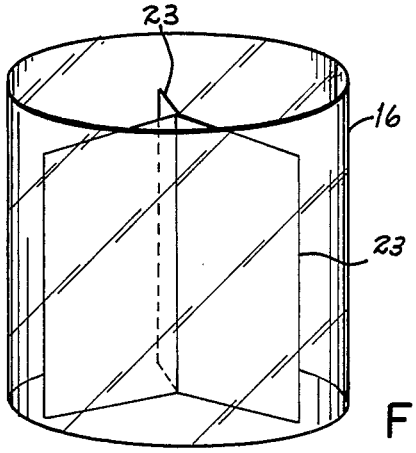
FIG. 4

DECORATIVE CANDLE

BACKGROUND OF THE INVENTION

This invention relates to candles, and in particular to a candle that can be made to have a decorative effect.

Traditionally a candle consists of a solid body of wax in which a wick is encased, the wick extending from the top of the candle to the base.

SUMMARY OF THE INVENTION

In accordance with the present invention, a candle arrangement has a body made up from a plurality of individual pieces of wax, a wick passing through this body, and containment means to keep the plurality of individual wax pieces together to form the candle body.

Such a candle can be made to have a variety of decorative effects.

Suitably each of the plurality of wax pieces is shaped, such that a plurality of these wax pieces can be stacked together to form a decorative candle body.

Preferably the plurality of wax pieces have a number of different shapes whereby a decorative candle can be formed having a number of different shaped components.

For instance, one wax piece may be square shaped, while another wax piece may be star shaped. In addition, these wax pieces can be of different colours and different sizes.

Alternatively, a candle can be divided into different regions, and each region supplied with a plurality of similar wax pieces, while the other regions are supplied with a plurality of different wax pieces.

The wick of the candle arrangement preferably has a base holder to support the wick. When a candle is being built, the wick is held upstanding and the plurality of wax pieces are placed around the wick to form the candle body.

The containment means for the plurality of wax pieces is suitably a transparent holder such that the different shapes and colours of the wax pieces can be viewed through the container.

The candle arrangement is suitably provided in kit form, in other words with a wick, a container and a bag of wax pieces such that the candle can be built up from its basic components.

The wax pieces are suitably formed from a plurality of different types of wax such as micro-crystalline wax, polyethylene wax and paraffin wax. Even more preferably the wax pieces are substantially made from approximately 90% paraffin wax, and less than 10% of other waxes. Most suitably the wax pieces are made from approximately 90% paraffin wax, approximately 7% micro-crystalline wax and approximately 1% polyethylene wax. The wax pieces are also impregnated with a colouring agent, and with titanium oxide in order to obtain the required whiteness/opaqueness. Preferably the wax pieces are impregnated with an air freshening agent, such that when the candle when not being burned, acts as an air freshener.

The advantage of the candle arrangement is that a number of different candle decorations can be made from the same set of wax pieces.

BRIEF DESCRIPTION OF THE DRAWINGS

FIG. 1 is a perspective view of a candle arrangement in accordance with the invention;

FIG. 2 shows a kit to form the candle arrangement shown in FIG. 1;

FIG. 3 shows a number of different wax pieces (shown enlarged) that can be used to build the body of the candle shown in FIG. 1; and FIG. 4 shows a candle container and wax piece divider.

DESCRIPTION OF THE PREFERRED EMBODIMENTS

In FIG. 1 a candle 10 is shown having a body 12, a wick 14 and a candle container 16.

The body 12 of the candle 10 is formed from a plurality of wax pieces 18 having different shapes, sizes and colours.

In FIG. 1 the wax pieces are shown stacked one upon the other to form the body of the candle.

The wax pieces are kept in a stacked state, since they are held in place within a outside container 16, which is suitably of transparent material such that the external surface of the candle body 12 is visible to the outside.

In the middle of the candle, the wick 14 is shown surrounded by the wax pieces 18, and in particular it will be noted (see FIG. 2) that the wick is supported at its place by a support member 20 which in use stands within the container.

In FIG. 2 a kit of components to form the candle arrangement 10 shown in FIG. 1 is shown, comprising the wick 14, container 16 and plurality of wax pieces 18 which are suitably provided in a bag 22. The candle of FIG. 1 can be easily built up from the kit parts shown in FIG. 2 by simply standing the wick 14 with its support member 20 within the container 16, and "pouring" in the candle pieces 18 into the container around the wick to form a candle body which has a decorative effect due to the different size, shape and colour of the wax pieces. A single bag 22 with different wax pieces can be supplied with the kit, or alternatively a number of bags can be supplied, each bag containing identical wax pieces, but different to wax pieces supplied in the other bags.

In FIG. 3 a number of different wax pieces 18 are shown having different shapes and sizes in order to exemplify the multitude of different possibilities that exist for wax pieces which make up the candle body, and the decorative nature of such candles.

Suitably the kit of parts shown in FIG. 2 is optionally provided with divider means 23 so that this can be placed into the container 16 (see FIG. 4) and identical wax pieces poured into one section of the divider means, and other wax pieces into the other sections of the divider means, to form a candle having sections with similar wax pieces in each section, but different wax pieces to other sections.

As will be envisaged, a candle having all identical wax pieces can be built up, or alternatively a candle having a number of different types of wax pieces can be built up. Furthermore, a candle having different layers of identical wax pieces could be formed as well as a candle having different sections of identical wax pieces as mentioned above.

Such candles are easy to build, simple to use, and provide an effective decorative external appearance.

What I claim is:

1. A candle comprising a plurality of individual wax pieces, some of said wax pieces having a characteristic selected from the group consisting of color, shape, size, and smell which other of said wax pieces do not have, a container within which said wax pieces are held, said container being transparent to permit said wax pieces to be viewed therethrough, a divider located within said container, said divider cooperating with said container to provide at least two different regions, those wax pieces with that characteristic which the other wax pieces do not have being located in one of said regions and the other wax pieces being located in the other of said regions, and a wick mounted to a base holder, said base holder being located within said container so that said wick extends up through said wax pieces.

2. A candle as claimed in claim 1, said wax pieces having at least two different shapes.

3. A candle as claimed in claim 1, said wax pieces having at least one of two different colors and two different sizes.

4. A candle as claimed in claim 3, said wax pieces being impregnated with a coloring agent, and with sufficient titanium oxide to obtain a desired opaqueness.

5. A candle as claimed in claim 1, said wax pieces being impregnated with an air freshening agent so that said candle acts as an air freshener when not being burned.

6. A candle as claimed in claim 1, said candle being in kit form with said wick, said container, and said wax pieces being separate one from the other.

* * * * *